US005222863A

United States Patent [19]

Jones

[11] Patent Number: 5,222,863

[45] Date of Patent: Jun. 29, 1993

[54] TURBINE MULTISECTION HYDROJET DRIVE

[76] Inventor: Brian L. Jones, 328 N. Airlite, Elgin, Ill. 60123

[21] Appl. No.: 753,990

[22] Filed: Sep. 3, 1991

[51] Int. Cl.[5] ..... F01D 9/00; B63H 11/113

[52] U.S. Cl. ..... 415/199.5; 415/194; 415/221; 415/222; 440/38; 440/42; 440/47; 60/221

[58] Field of Search ..... 415/181, 182.1, 191, 415/193, 194, 198.1, 199.4, 199.5, 209.1, 211.2, 220, 221, 222, 914; 416/204 R, 204 A, 219 R, 219 A; 60/221, 222; 440/38, 40, 42, 47

[56] References Cited

U.S. PATENT DOCUMENTS

| | | | |
|---|---|---|---|
| 0,039,394 | 8/1863 | Harris | 440/47 |
| 1,304,793 | 5/1919 | Moore | 416/219 R |
| 1,759,511 | 5/1930 | Kort | 60/221 |
| 2,381,459 | 8/1945 | Merrick | 416/219 A |
| 3,624,737 | 11/1971 | Keller | 440/42 |
| 4,718,870 | 1/1988 | Watts | 440/38 |
| 4,902,254 | 2/1990 | Chas | 440/38 |
| 4,940,387 | 7/1990 | Horne et al. | 415/221 |

FOREIGN PATENT DOCUMENTS

| | | | |
|---|---|---|---|
| 0121245 | 4/1946 | Australia | 415/199.5 |
| 0886676 | 8/1953 | Fed. Rep. of Germany | 416/219 R |
| 2300821 | 7/1974 | Fed. Rep. of Germany | 440/42 |
| 0616505 | 2/1961 | Italy | 440/38 |
| 0001330 | of 1879 | United Kingdom | 60/221 |

*Primary Examiner*—Edward K. Look
*Assistant Examiner*—Christopher Verdier
*Attorney, Agent, or Firm*—William K. Serp

[57] ABSTRACT

A hydrojet turbine drive 10 is described with a first turbine assembly 40 including a first compressor rotor 46 with blades 48 having a water pitch for drawing water into the turbine drive 10. The water is driven against the walls of a housing 18 and into a first stator 56 resulting in a portion of the water breaking down into its gaseous components. The water-gas fluid is reoriented and directed by the first stator 56 into a second turbine assembly 42 including a second compressor rotor 68 the blades 72 of which define a gas pitch. The circular flow therefrom is forced into a second stator 70 whereat additional water is reduced to its gaseous components. The water-gas fluid is directed by the second stator 70 into a third turbine assembly 44 including a third compressor rotor 88 the blades 94 of which also have a gas profile. A third stator 90 directs the water-gas fluid into a buffer zone 114 wherein the water-gas fluid expands thus reducing the back pressure on the third stator 90 and the fluid is pressurized within a nozzle 120 and exhausted therefrom.

16 Claims, 5 Drawing Sheets

TURBINE MULTISECTION HYDROJET DRIVE

BACKGROUND OF THE INVENTION

1. Technical Field

This invention generally relates to a turbine drive and more particularly relates to a turbine hydrojet drive which is particularly adapted for operation in water.

RELATED ART

Gas turbine drives have reached a high degree of development and are utilized in many applications such as airplane and boat propulsion systems. These vehicles are often propelled by a gas turbine drive operating in the atmosphere. Such drives intake air, compress the air, heat the air and exhaust it thus producing a forward thrust. Relatively high efficiencies are obtained in the order of 85 to 99% as compared to air propeller systems which exhibit in the order of 46% efficiency.

Heretofore, turbine drives have not functioned effectively in a relatively incompressible liquid such as water. Due to the incompressibility of water, presently known turbine drives have not produced sufficient fluid compression to generate acceptable thrust levels. In water, propeller systems have generally been used which exhibit low efficiencies in the order of 7 to 9%. The drag and high resistance which the water exerts on the rotating propeller greatly limits the efficiencies obtainable. To provide one solution to this problem, it has been suggested that a turbine drive operating in water be provided with a compressible fluid by injecting helium gas into the turbine drive. The helium is compressed along with a quantity of intake water, the water-helium fluid is exhausted and the expanding fluid produces thrust. Such systems are expensive due to the required external source of helium as well a being large and cumbersome. As will be more fully described, this invention provides a turbine hydrojet drive which is operable while fully immersed in water. It is operable without the introduction of any external gas supplies and produces thrust at high efficiencies in the order of 90 to 95%.

SUMMARY OF THE INVENTION

Described is a turbine hydrojet drive as well as the method of operation thereof. The turbine hydrojet drive includes an elongated housing adapted to be fixed to a vehicle. The housing defines an intake section, a compressor section and an exhaust section. A drive shaft is positioned for rotation within the housing. The compressor section includes a first turbine assembly having a first compressor rotor fixed to the drive shaft and a plurality of first rotor blades projecting radically outwardly from the drive shaft. The first compressor rotor blades have a water pitch adapted for rotation in a first direction so as to bring a predetermined quantity of water into the housing. The first turbine assembly additionally includes a first stator with the outwardly projecting ends of the stator vanes fixed to the inner wall of the housing and serving to redirect the circular flow of water from the first compressor rotor into a fluid flow generally along the axis of the drive shaft. The exhaust section includes a buffer zone defining a cross-sectional area so that the pressure of the fluid passing therethrough is reduced and correspondingly the back pressure on the first turbine assembly is reduced.

A method of operation of a turbine hydrojet drive is described including the steps of drawing water into an elongated cylindrical housing having a central axis, rotating the water at a very high rate of speed and forcing the water against the walls of the housing and against the first stator vanes. A portion of the water thereby separates into its gaseous components and the water-gas fluid is compressed. The flow path of the water-gas fluid is reoriented generally along the axis of the housing. The fluid pressure is decreased within a buffer zone and then exhausted from the nozzle producing forward thrust.

DESCRIPTION OF THE PREFERRED EMBODIMENT

General

Throughout the following description, the theoretical, physical principles in accordance with which the preferred embodiment appears to operate have been set forth. Although every attempt has been made to describe these physical principles accurately, it may be subsequently determined, based on additional information, that this explanation is not completely accurate. It should be appreciated that the discussion of these physical principles is provided to clarify the theoretical operation of the preferred embodiment and not to limit the scope of the apparatus or method as claimed.

Figure 1:
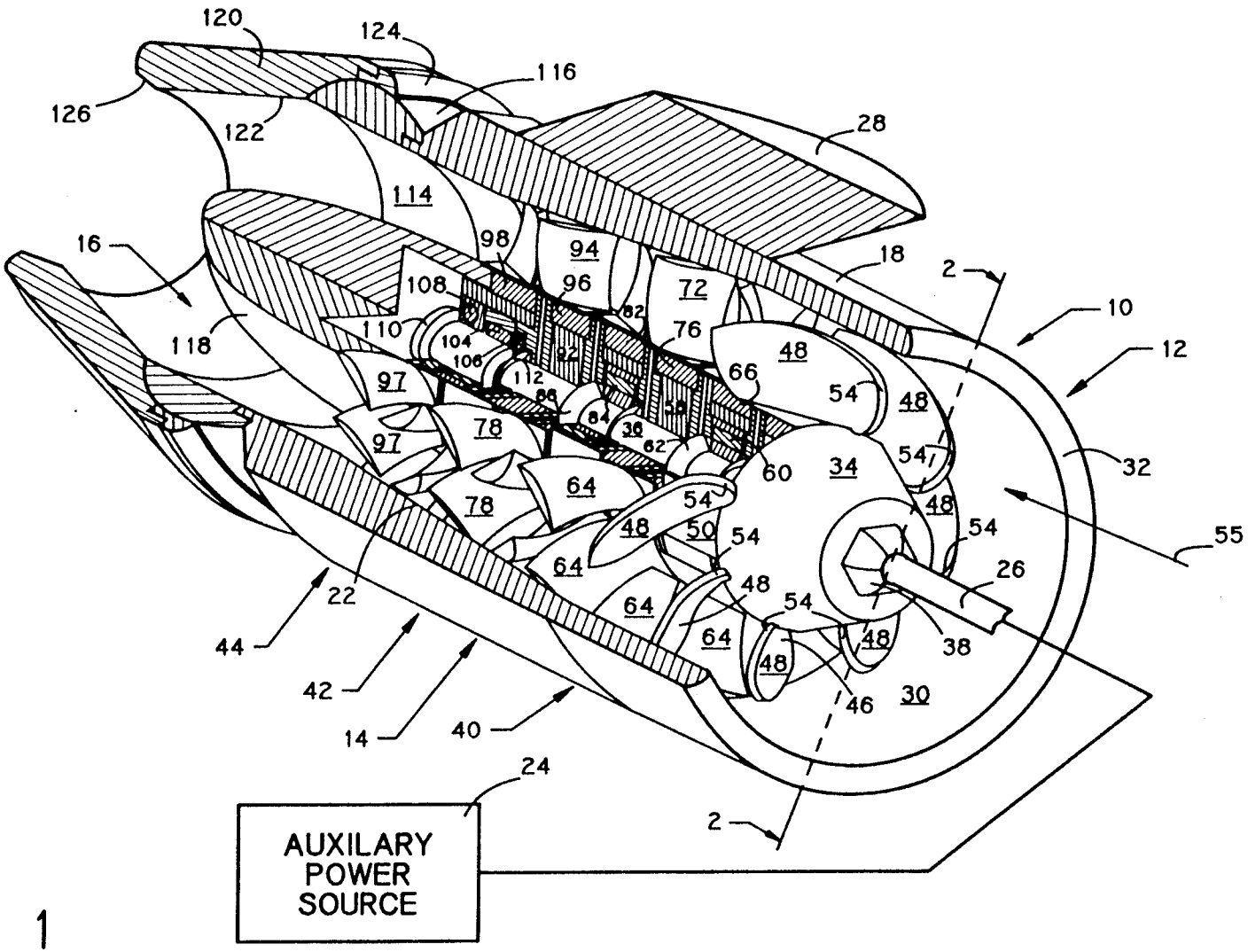
FIG. 1 is a perspective view of a turbine hydrojet drive embodying certain features of this invention with a portion removed for clarity of illustration.

A turbine hydrojet drive 10 is illustrated in FIG. 1 which includes an intake section 12, a compressor section 14 and an exhaust section 16. The intake 12 and compressor 14 sections as well as a portion of the exhaust section 16 are maintained within an elongated generally cylindrically shaped housing 18 with that portion defining the intake section 12 being a uniform cylinder. The inner walls 22 of the housing 18 defining the compressor section 14 display a slight inwardly directed taper of approximately four degrees. This inner wall 22 taper serves to increase the fluid compression within the housing 18 as will subsequently be more fully appreciated. High speed rotational power is provided by an auxiliary, rotary power source 24 coupled by a connecting shaft 26 to the turbine hydrojet drive 10. As illustrated, the housing 18 is mounted upon a vehicle (not shown) by a support strut 28 which is firmly secured to the outer wall of the housing 18 adjacent the compressor section 14. In use, the turbine hydrojet drive 10 is submerged in water while the vehicle (not shown) rides on the surface.

Intake Section

Figure 2:
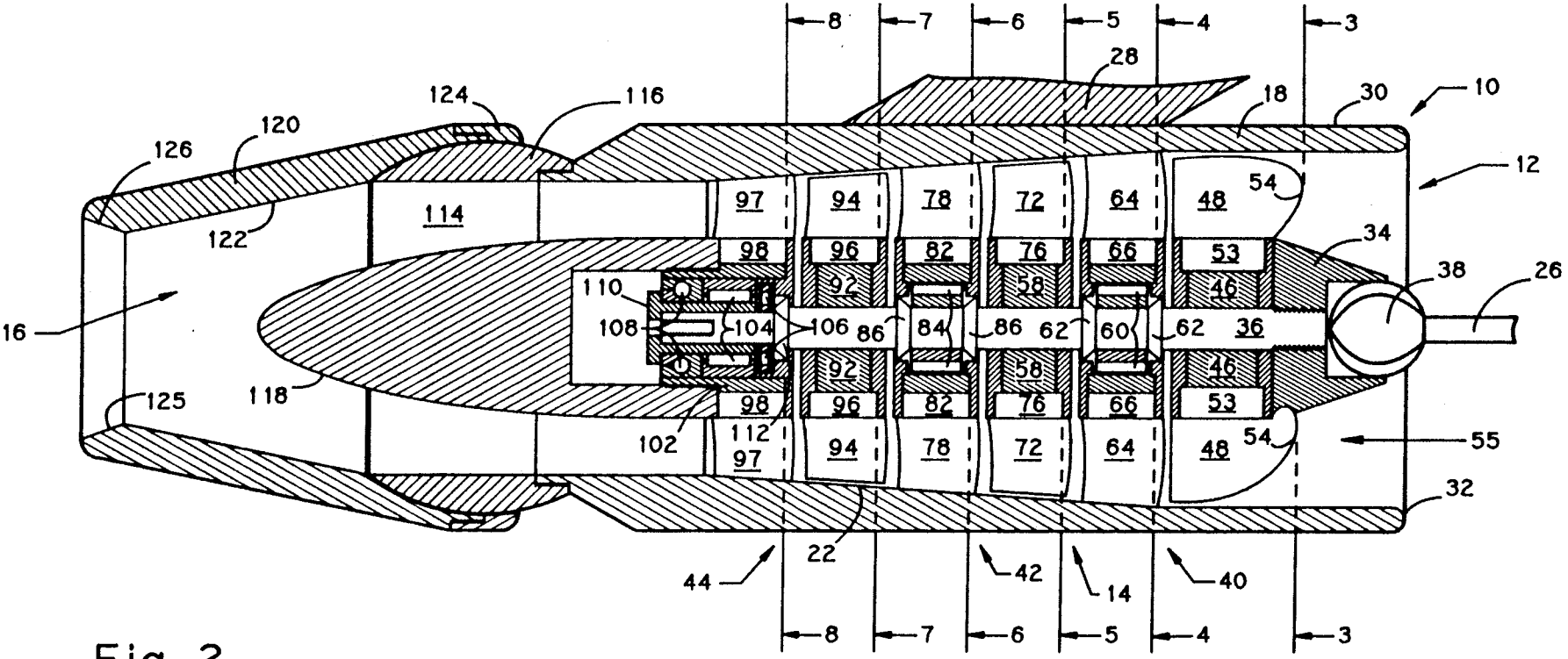
FIG. 2 is a full section view of the drive of FIG. 1 taken along the line 2—2.

As illustrated in FIG. 2, the intake section 12 of the housing 18 defines an intake cowling 30 the forward edge of which is slightly rounded as at 32 to reduce resistance and introduce minimum turbulence while parting and directing the water into the housing 18. The auxiliary power source 24 is coupled by the connecting shaft 26 to a conically shaped intake drive hub 34 secured to the forward end of a drive shaft 36 mounted for rotation within the housing 18. The intake drive hub 34 is coupled to the connecting shaft 26 by means of a swivel socket 38 and rotates under power provided by the auxiliary power source 24. The shape of the hub 34 is selected to present a low resistance to the inflow of water into the housing 18.

Compressor Section

Figure 3:
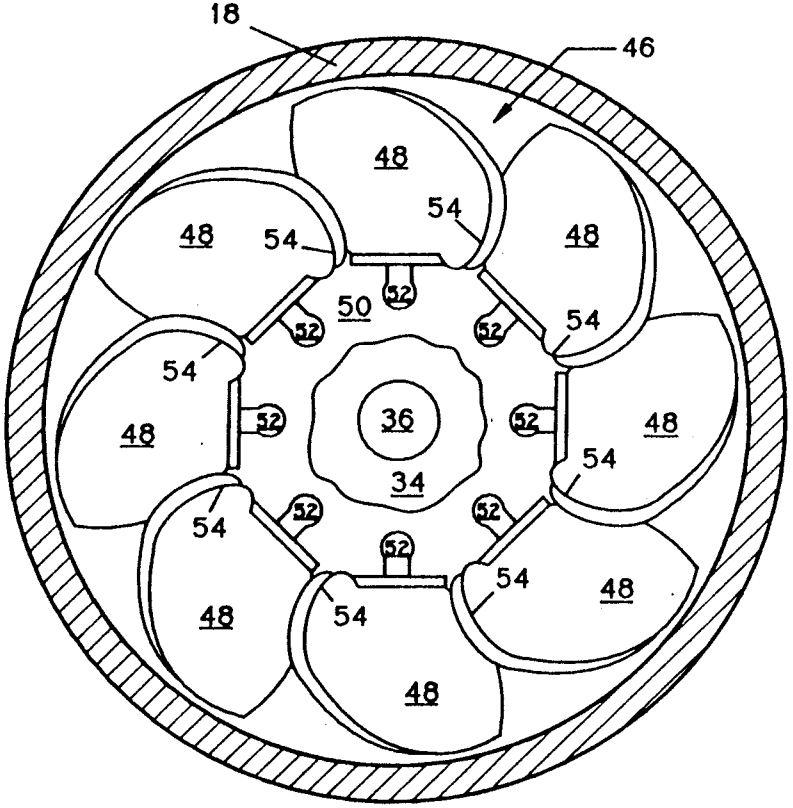
FIG. 3 is a full section view taken along the line 3—3 of FIG. 2 with a portion removed for clarity of illustration.

As illustrated, the compressor section 14 includes first 40, second 42 and third 44 turbine assemblies. Fixed to the drive shaft 36 and positioned adjacent the intake hub 34 is the first turbine assembly 40 which includes a first compressor rotor 46. As particularly shown in FIG. 3, the first compressor rotor 46 has eight equally spaced 48 blades which are fixed to a first rotor hub 50 secured to the drive shaft 36. The inwardly directed ends of each of the first compressor rotor blades 48 has a male bulbroot 52 which mates with a corresponding female bulbroot socket machined into the outer surface of the first rotor hub 50. The leading edges of the rotor blades 48 are tapered following a profile know in the art as a water pitch. The term pitch is used in its conventional sense as a measure of the distance a rotor will travel in one complete revolution in a medium without encountering resistance. Each of the first compressor rotor blades 48 serve to slice and pull water into the turbine drive housing 18. The leading edge 54 of each of the first compressor rotor blades 48 extends slightly beyond the forward edge of the hub 50 and is tapered to define a projecting blunt point. The pitch of the first compressor rotor blades 48 is carefully selected to bring in a predetermined quantity of water necessary for efficient operation while introducing a minimum amount of drag.

Figure 4:
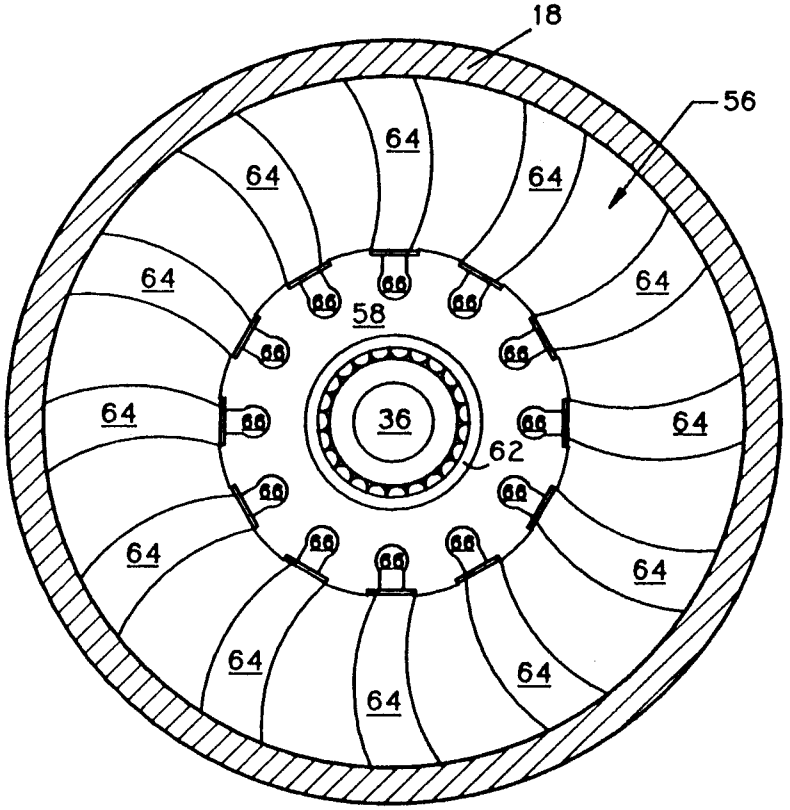
FIG. 4 is a full section view taken along the line 4—4 of FIG. 2.

Positioned in the direction of fluid flow, as indicated by the arrow 55, immediately behind the first compressor rotor 46 is a first stator 56. As shown in FIG. 4, the first stator 56 includes a hub 58 having a radial bearing 60 through which the drive shaft 36 passes for free rotation therein. The bearings 60 are protected by fluid seals 62. Mounted to the outer surface of the first stator hub 58 are twelve equally spaced first stator vanes 64. Each of the first stator vanes 64 is mounted to the first stator hub 58 by a bulbroot assembly 66. The stator vanes 64 display a relatively flat profile with the leading edge of each vane 64 being on a common plane with the forward surface of the first stator hub 58 and each is secured to the inner wall of the housing 18 by suitable means. It will be appreciated that since the stator vanes 64 are secured to the inner wall of the housing 18 and support the hub 58, the position of the drive shaft 36 is precisely maintained within the housing 18. As illustrated particularly in FIG. 1, the pitch direction of the first stator vanes 64 is opposite to the pitch direction of the first compressor rotor blades 48 in order to straighten the circular flow of the water-gas fluid discharged by the first compressor rotor 46. The vanes 64 redirect the circular flow of the water-gas fluid coming from the first compressor rotor 46 into a flow substantially along the longitudinal axis of the drive shaft 36.

The drive shaft 36 is driven at a high rotational speed and the intake water, which now has a strong circular momentum, is forced outwardly by the first compressor rotor 46 against the inner walls of the housing 18 and against the leading edges of the first stator vanes 64. This force, which is abruptly resisted by the stator vanes 64 and the inner wall of the housing 18, causes a small amount of the water molecules to break down into their constituent parts of oxygen and hydrogen. Thus, due to the centrifugal and axial thrust of the first compressor rotor 46, the water is forced against the walls of the housing 18 and stator vanes 64 reducing a portion of the water to a gas. During testing of a prototype of the turbine drive 10, embodying certain features of this invention, it was found that approximately fifteen percent of the intake water had been broken down into its gaseous components within the first turbine assembly 40 while operating the prototype at approximately 7,500 rpm.

Figure 6:
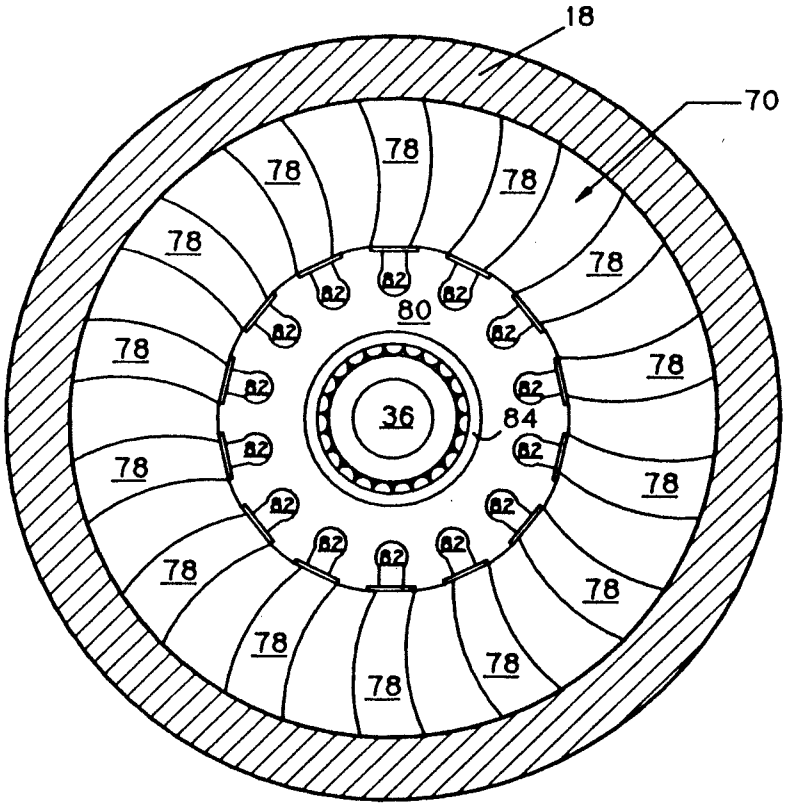
FIG. 6 is a full section view taken along the line 6—6 of FIG. 2.

Positioned adjacent and in the direction of fluid flow 55 from the first turbine assembly 40 and receiving the compressed water-gas fluid therefrom is the second turbine assembly 42 comprising a second compressor rotor 68 (FIG. 5) and a second stator 70 (FIG. 6). As illustrated, the second compressor rotor 68 includes fourteen compressor blades 72 mounted to a second rotor hub 74 by bulbroot fasteners 76 with the hub 74 being fixed to the drive shaft 36 for rotation therewith. Since the second compressor rotor blades 72 receive a water-gas fluid with a relatively high gas content, they display a profile known in the art as an air pitch. The air pitch effectively allows the second compressor rotor blades 72 to push the compressed water-gas fluid through the turbine hydrojet drive 10 whereas the first compressor rotor 46 pulls the water into the turbine hydrojet drive 10. The pitch of the second compressor stator blades 72 is considerably greater than the pitch of the first compressor rotor blades 48. The previously mentioned prototype turbine hydrojet drive 10 was constructed with first compressor rotor blades 48 having a pitch of four and a half inches and second compressor rotor blades 72 having a pitch of 14.84 inches. That is, in this prototype, the second compressor rotor blades 72 had a pitch almost three and a half times as great as the pitch of the first compressor rotor blades 48. The water-gas fluid, which has as a generally axially flow pattern from the first stator 56 is again whirled at a high rate of speed by the second compressor rotor 68. Due to the centrifugal forces created, a certain portion of the water is slammed against the inner wall of the housing 18 and the remaining water-gas fluid is forced into the second stator 70.

Figure 5:
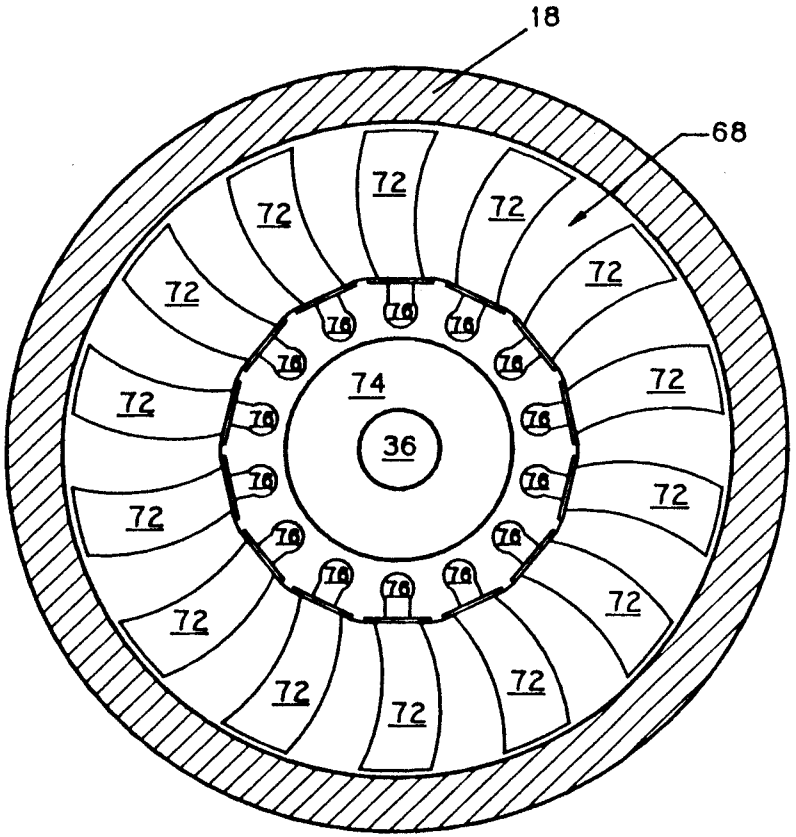
FIG. 5 is a full section view taken along the line 5—5 of FIG. 2.

The second stator 70 includes fourteen equally spaced radially oriented vanes 78 secured to the inner wall of the housing 18. The inwardly extending ends of the second stator vanes 78 are mounted on a hub 80 by means of bulbroot fasteners 82. The drive shaft 36 is supported in the hub 80 by radial bearings 84 protected by a fluid seal 86. It should be noted that the second compressor rotor blades 72 as well as the second stator vanes 78 are shorter than their respective first turbine assembly 40 counterparts due to the previously mentioned four degree taper of the inner walls of the housing 18. As illustrated in FIGS. 5 and 6, the pitch of the second stator vanes 78 is opposite to the pitch of the second compressor rotor blades 72 and therefore redirects the rotating water-gas fluid from the second compressor rotor 68 into a flow pattern having a generally axial orientation. The high speed rotation of the second compressor rotor blades 72 forcefully drives the water-gas fluid against the walls of the housing 18 and into the second stator vanes 78 resulting in the further breakdown of an additional portion of the water into its gaseous components. During an analysis of the previously mentioned prototype, it was determined that approximately fifty percent of the water drawn into the turbine drive 10 had been converted into its gaseous components by the time it had passed through the second turbine assembly 42.

Figure 8:
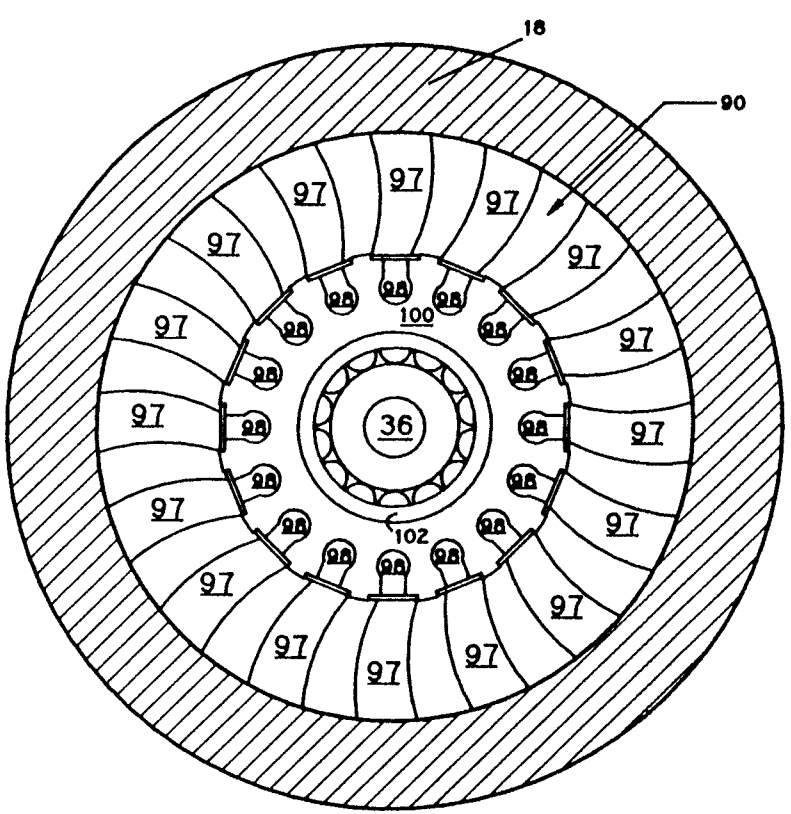
FIG. 8 is a full section view taken along the line 8—8 of FIG. 2.
Figure 7:
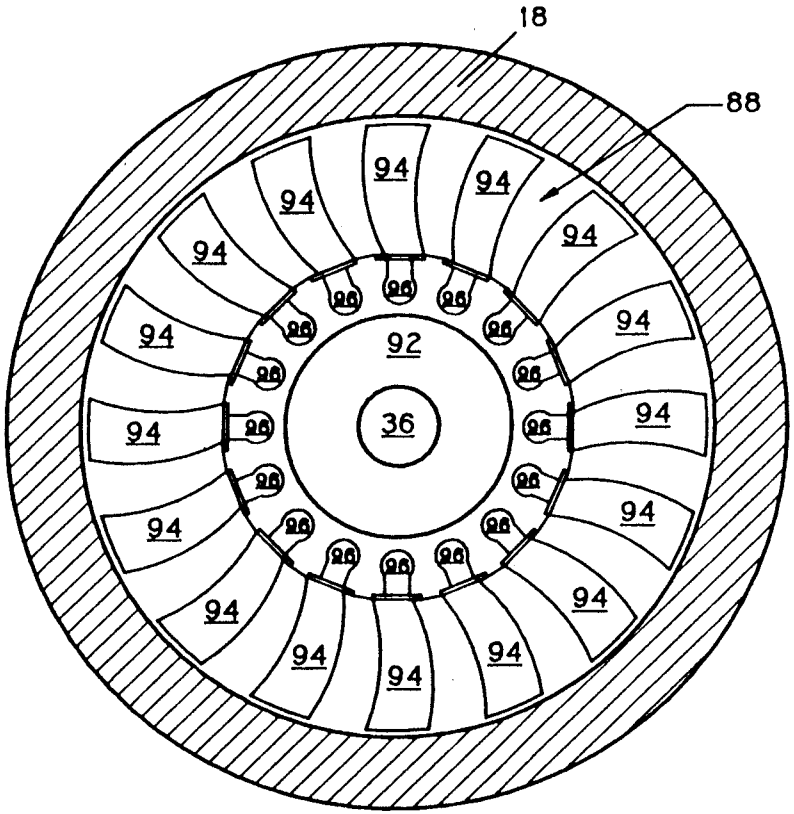
FIG. 7 is a full section view taken along the line 7—7 of FIG. 2.

The compressed water-gas fluid from the second turbine assembly 42 is forced into the third turbine assembly 44 which similarly includes a third compressor rotor 88 (FIG. 7) and a third stator 90 (FIG. 8). The third compressor rotor 88 is of similar configuration to the second compressor rotor 68 and includes a rotor hub 92 fixed to the drive shaft 36 for rotation therewith. Projecting radially from the hub 92 and uniformly spaced are sixteen rotor blades 94 mounted by bulbroots 96. As illustrated, the blades 94 have a pitch slightly greater than the pitch of the second compressor rotor blades 72. The previously mentioned prototype included a second compressor rotor 68 with blades 72 having a pitch of 14.84 inches and the third compressor rotor blades 94 having a pitch of 18.25 inches. The increased number of blades 94 and their increased pitch, as compared to the second compressor rotor blades 72, was selected to more efficiently compress the water-gas fluid, with its increased percentage of gas, in the third turbine assembly 44. As mentioned, the walls of the housing 18 taper inwardly and the third rotor compressor blades 94 are slightly shorter than the second rotor compressor blades 72 to accommodate this housing taper. It was found preferable, due to the increased compression of the water-gas fluid as well as the reduced cross-sectional area and volume of the housing 18 in the third turbine assembly 44, to increase the number of blades 94 in the third compressor rotor 88 as compared to the second compressor rotor 68 to more efficiently handle the increased fluid mass. The water-gas fluid is forced by the third compressor rotor 88 into the third stator 90 and outwardly against the inner walls of the housing 18.

As illustrated, the third stator 90 includes sixteen equally spaced vanes 97 the outer ends of which are secured to the inner wall of the housing 18. The pitch of the third stator vanes 97 is opposite to the pitch of the third compressor rotor blades 94. The inwardly directed ends of the third stator vanes 97 are mounted by means of bulbroot assemblies 98 to the surface of a third stator hub 100. The third stator hub 100 includes a radial bearing 104 as well as a front 106 and a rear 108 thrust bearing which are assembled on the end of the drive shaft 36 by means of a threaded end cap 110. A protective seal 112 is positioned on the drive shaft 36 adjacent the front thrust bearing 106. As the water-gas fluid is whirled at a very high rate of speed by the third compressor rotor 88 it is forced against the stator vanes 97 and, in a manner similar to that previously discussed in connection with the first 40 and second 42 turbine assemblies, additional water molecules are broken into their gaseous components. The water-gas fluids circular flow is straightened by the third stator 90 into a substantially axial flow pattern. The compressed water-gas fluid is forced out of the third turbine assembly 44 into the exhaust section 16. With reference to the previously mentioned prototype, it was found that at the output of the third turbine assembly 44, eighty to ninety percent of the intake water had been converted into compressible gas. It should be appreciated that additional turbine sections exceeding the three illustrated may be desirable or even a single turbine assembly may be adequate for the application to which the turbine hydrojet drive 10 is to be used without departing from the scope and spirit of this invention.

Exhaust Section

The exhaust section 16 includes a buffer zone 114 which serves to reduce the back pressure against the third turbine assembly 44 to prevent the water-gas fluids within the buffer zone 114 from being forced back into the third stator 90 which occurrence would greatly decrease the efficiency of the turbine hydrojet drive 10. The inner wall of the housing 18 defining the buffer zone 114 is in the form of a relatively uniform cylinder correspondingly defining a uniform volume. Securely threaded to the outer wall of the housing 18 is a pivot ball swivel extension 116. The inner surface of the pivot ball swivel extension 116 continues the uniform cylindrical shape of the inner wall of the housing 18 contributing to the size of the buffer zone 114. Positioned within the buffer zone 114 is a tail cone 118 having a frustro conical shape with the base of the cone 118 positioned adjacent the third stator 90. Thus, the cross sectional area of the buffer zone 114 increases from the intake end adjacent to the third stator 90 to the discharge end. This volume increase allows the water-gas fluid from the third turbine assembly 44 to expand, and therefore pressure within the buffer zone 114 decreases reducing the back pressure on the third turbine assembly 44. The exhaust from the buffer zone 114 discharges into a nozzle 120. As illustrated, the tail cone 118 is threaded upon an extension of the third stator hub 100 and extends into the nozzle 120.

The nozzle 120 has a tapered conical wall section 122 which has a curved inwardly disposed surface for mating engagement with the pivot ball swivel extension 116 as well as a ring of threads on the outer surface which engage threads on a nozzle retaining ring 124. The retaining ring 124 secures the nozzle 120 to the pivot ball swivel extension 116. The retaining ring 124 secures the nozzle 120 to the pivot ball swivel extension 116. Thus, the inner wall 122 of the nozzle 120 is in the shape of a section of a cone with a decreasing cross-sectional area as the nozzle 120 progresses from the buffer zone 114 to an exhaust orifice 125. The cross-sectional area of the end of the tail cone 118 decreases at a slower rate than the cross-sectional area of the nozzle 120. Thus, the water-gas fluid pressure within the nozzle 120 progressively increases. With respect to the operation of the previously mentioned prototype, a three fold pressure increase was observed within the nozzle 120. The pressurized fluid from the nozzle 120 is directed by a diffuser 126 which is in the form of an outwardly directed taper on the inner wall of the discharge end of the nozzle 120. The diffuser 126 is shaped to direct the water-gas fluid for expansion out beyond the end of the nozzle 120 so that any low pressure vortices created do not produce drag on the housing 18. The nozzle 120 is positioned to divert the exhaust therefrom in the desired direction by loosening the engagement of the nozzle 120 with the retaining ring 124 and pivoting the nozzle 120 about the ball swivel extension 116 to the desired position. Thereafter, the nozzle 120 is secured by tightening the retaining ring 124.

Operation

In operation, the turbine hydrojet drive 10 is submerged in water and the auxiliary power source 24 rotates the drive shaft 36 at a very high speed. The eight blades 48 of the first compressor rotor 46, have a water pitch and pull water into the housing 18 forcing it against the first stator vanes 64 whereupon a portion of the water is broken into its gaseous components. The fluid flow is aligned by the first stator 56 generally along the axis of the housing 18 for introduction into the second compressor rotor 68. Due to the previously mentioned forces abruptly stopping and redirecting the water molecules, the fluid entering the second turbine assembly 42 contains a relatively high gas content allowing the water-gas fluid to be compressed. The second compressor rotor 68, having an air pitch, drives the water-gas fluid into the second stator 70 whereat it is realigned. Additionally, a still greater portion of the water is broken down into its gaseous components. The water-gas fluid, which is under pressure, is forced into the third compressor rotor 88 and the fluid is realigned by the third stator 90. The compressed fluid is forced into the buffer zone 114 whereat the fluid is allowed to slightly expand thus reducing the back pressure on the third turbine assembly 44. The pressurized fluid passes therefrom into the nozzle 120 whereat the fluid is significantly recompressed and finally the compressed water-gas fluid passes through the nozzle 120 producing a thrust which is coupled through the support strut 28 to a vehicle (not shown). Desired vehicle lift is provided by adjusting the position of the nozzle 120 on the pivot ball swivel extension 116 with respect to the housing 18 and locking it in place with the retaining ring 124. During operation of the aforementioned prototype, it was noted that the exhaust from the drive contained gas bubbles which did not escape to the surface of the water. Rather the gasses recombined, in the water behind the nozzle 120, into water. This recombination of the exhaust gasses into water provided an incompressible medium against which the subsequent drive exhaust reacted resulting in improved drive efficiency.

A turbine hydrojet drive 10 and method of operation thereof has been described. Although a single embodiment of the invention has been considered, it will be understood that various changes in form and detail may be made without departing from the scope and spirit of the invention as set forth in the following claims.

What is claimed is:

1. A turbine hydrojet drive comprising:

an elongated housing defining an inner and an outer wall with a portion of said outer wall adapted to be secured to a vehicle, said housing defining an intake section, a compressor section, and an exhaust section having an intake end and an exhaust end;

a drive shaft positioned within said housing for rotation therein;

said compressor section including a first turbine assembly having a first compressor rotor fixed to said drive shaft;

a plurality of first rotor blades projecting radially outwardly from said drive shaft, said first rotor blades having a first water pitch adapted for rotation in a first direction and configured to slice and draw a predetermined amount of water into said housing;

said compressor section further including a first stator having a plurality of first stator vanes fixed to said inner wall of said housing and having a pitch adapted to redirect the circular flow of water from said first compressor rotor into a fluid flow generally along the axis of the drive shaft and into said exhaust section;

said exhaust section includes a buffer zone defining a progressively increasing cross-sectional area so that the pressure of the fluid passing therethrough is reduced, whereby compressed fluid exhausted from said exhaust section generates a thrust which is coupled to the vehicle resulting in propulsion thereof;

a nozzle, defined by a wall, forming a portion of said exhaust section and being in the form of a hollow, frustro conical member having a base and a top with said base positioned at said exhaust end of said exhaust section of said housing and movable relative to said housing; and means for selectively securing said base of said frustro conical member to said exhaust end of said exhaust section of said housing so that said nozzle can be selectively positioned with respect to said housing and wherein the inner edge of said wall of said frustro conical member defining said top opposite said base is tapered to direct the fluid for expansion beyond said exhaust nozzle so that any low pressure vortices created do not product drag on said housing.

2. A turbine hydrojet drive comprising:

an elongated housing defining an inner and an outer wall with a portion of said outer wall adapted to be secured to a vehicle, said housing defining an intake section, a compressor section, and an exhaust section having an intake end and an exhaust end;

a drive shaft positioned within said housing for rotation therein;

said compressor section including a first turbine assembly having a first compressor rotor fixed to said drive shaft;

a plurality of first rotor blades projecting radially outwardly from said drive shaft, said first rotor blades having a first water pitch adapted for rotation in a first direction and configured to slice and draw a predetermined amount of water into said housing;

said compressor section further including a first stator having a plurality of first stator vanes fixed to said inner wall of said housing and having a pitch adapted to redirect the circular flow of water from said first compressor rotor into a fluid flow generally along the axis of the drive shaft and into said exhaust section;

said exhaust section includes a buffer zone defining a progressively increasing cross-sectional area so that the pressure of the fluid passing therethrough is reduced, whereby compressed fluid exhausted from said exhaust section generates a thrust which is coupled to the vehicle resulting in propulsion thereof;

a tail cone displaying a conical shape and having a base positioned adjacent said first stator and extending into said buffer zone, the cross-sectional area of said buffer zone decreasing progressively from the base of said tail cone to said exhaust nozzle so that the fluid pressure decreases therethrough; and an exhaust nozzle in the form of a hollow, frustro conical member the base of which is positioned at said exhaust end of the exhaust section of said housing wherein the taper of said exhaust nozzle results in an increase in the pressure of the fluid passing therethrough.

3. A turbine hydrojet drive comprising:

an elongated housing defining an inner and an outer wall with a portion of said outer wall adapted to be secured to a vehicle, said housing defining an intake section, a compressor section, and an exhaust section having an intake end and an exhaust end;

a drive shaft positioned within said housing for rotation therein;

said compressor section including a first turbine assembly having a first compressor rotor fixed to said drive shaft;

a plurality of first rotor blades projecting radially outwardly from said drive shaft, said first rotor blades having a first water pitch adapted for rotation in a first direction and configured to slice and draw a predetermined amount of water into said housing;

said compressor section further including a first stator having a plurality of first stator vanes fixed to said inner wall of said housing and having a pitch adapted to redirect the circular flow of water from said first compressor rotor into a fluid flow generally along the axis of the drive shaft and into said exhaust section;

said exhaust section includes a buffer zone defining a progressively increasing cross-sectional area so that the pressure of the fluid passing therethrough is reduced, whereby compressed fluid exhausted from said exhaust section generates a thrust which is coupled to the vehicle resulting in propulsion thereof;

an exhaust nozzle, in the form of a hollow, frustro conical member having a base and a top with said base positioned at said exhaust end of said exhaust section of said housing and movable relative to said housing;

means for selectively securing said frustro conical member of said exhaust nozzle to said housing so that said nozzle can be selectively positioned; and a tail cone displaying a conical shape and having a base and a top with said base positioned adjacent said first stator, the cross-sectional area of said buffer zone decreasing progressively from the base of said tail cone to said exhaust nozzle whereby the pressure of fluid flowing through said buffer zone decreases and the pressure of fluid flowing through said exhaust nozzle increases.

4. A turbine hydrojet drive comprising:

an elongated housing defining an inner and an outer wall with a portion of said outer wall adapted to be secured to a vehicle, said housing defining an intake section, a compressor section, and an exhaust section having an intake end and an exhaust end;

a drive shaft positioned within said housing for rotation therein;

said compressor section including a first turbine assembly having a first compressor rotor fixed to said drive shaft;

a plurality of first rotor blades projecting radially outwardly from said drive shaft, said first rotor blades having a first water pitch adapted for rotation in a first direction and configured to slice and draw a predetermined amount of water into said housing;

said compressor section further including a first stator having a plurality of first stator vanes fixed to said inner wall of said housing and having a pitch adapted to redirect the circular flow of water from said first compressor rotor into a fluid flow generally along the axis of the drive shaft and into said exhaust section;

said exhaust section includes a buffer zone defining a progressively increasing cross-sectional area so that the pressure of the fluid passing therethrough is reduced, whereby compressed fluid exhausted from said exhaust section generates a thrust which is coupled to the vehicle resulting in propulsion thereof;

a second turbine assembly positioned between said first turbine assembly and said buffer zone, said second turbine assembly including a second compressor rotor having a plurality of radially extending blades affixed to a second rotor hub, said second rotor hub being secured to said drive shaft for rotation therewith, said second compressor rotor blades having a second gas pitch which is greater than said first water pitch of said first rotor blades and particularly configured for efficient operation in a gas environment and for rotation in a first direction; and a second stator having a plurality of radially extending second stator vanes having a pitch adapted to redirect the circular flow of fluid from said second compressor rotor into a generally axially oriented flow whereby the fluid passing through said second turbine assembly is further compressed.

5. The hydrojet drive of claim 4 wherein the inner walls of said housing are tapered so that the cross-sectional area of said housing is progressively smaller in the direction of fluid flow through said compressor section; and wherein the diameter of said first compressor rotor is greater than the diameter of said second compressor rotor to accommodate said inner housing wall taper, and wherein the pitch of said second compressor rotor is greater than the pitch of said first compressor rotor.

6. The hydrojet turbine drive of claim 5 wherein the number of blades on said second compressor rotor is greater than the number of blades on said first compressor rotor.

7. The hydrojet drive of claim 4 wherein said compressor section further comprises:

a third turbine assembly positioned between said second turbine assembly and said buffer zone, said third turbine assembly including a compressor rotor having a plurality of radially extending third rotor blades displaying a third gas pitch which is greater than said first, water pitch of said first rotor blades and particularly configured for operation in a gas environment, said third rotor blades being fixed to a third rotor hub, said third hub being secured to said drive shaft for rotation therewith; and a third stator including a plurality of radially extending third stator vanes the outer ends of which are firmly affixed to the inner wall of said housing, said third stator vanes having a pitch adapted to redirect the circular flow of water from said second compressor rotor into a fluid flow oriented generally along the axis of said drive shaft whereby the pressure of the fluid passing through said third turbine assembly is increased.

8. The turbine hydrojet drive of claim 7 wherein said first, second, and third rotors have a pitch in a first direction and said first, second and third stators have a pitch in a second direction opposite to said first direction and further wherein said exhaust section includes an exhaust nozzle; and means for positioning said nozzle with respect to said housing so a to direct the exhaust from said drive in a predetermined direction.

9. The turbine hydrojet drive of claim 8 wherein the inner walls of said housing throughout said compressor section are tapered whereby the cross-sectional area of said housing is progressively smaller along the path of fluid flow through said compressor section;

the diameter of said first compressor rotor is greater than the diameter of said second compressor rotor and wherein the diameter of said second compressor rotor is greater than the diameter of said third compressor rotor to accommodate the taper of said inner wall; and said second compressor rotor blades have a greater pitch than the pitch of said first compressor rotor blades, and the pitch of said third compressor rotor blades is greater than the pitch of said second compressor rotor blades.

10. The hydrojet drive of claim 9 wherein said second stator has a greater number of second stator vanes than said first stator and wherein said third stator has a greater number of third stator vanes than said second stator.

11. The turbine hydrojet drive of claim 10 wherein said exhaust section includes:

a tail cone displaying a conical shape and having a base, with said cone positioned with said base adjacent said third stator, the cross-section area of said buffer zone decreasing progressively from the base of said tail cone to said exhaust nozzle whereby the pressure of the fluid passing therethrough decreases; and said exhaust nozzle being tapered thereby reducing the cross-sectional area of the nozzle and increasing the pressure of the fluid passing therethrough.

12. The turbine hydrojet drive of claim 11 wherein said exhaust nozzle includes a hollow frustro conical member having a base end and a top end narrower in cross-section than said base end with said base of said conical member positioned at said exhaust end of said housing and movable relative to said housing; and means for selectively securing said hollow frustro conical member to said housing facilitating the positioning of said nozzle with respect to said housing so that the exhaust from said turbine hydrojet drive can be oriented in a desired direction.

13. The turbine hydrojet drive of claim 12 wherein each of said first, second and third stators respectively include centrally located first, second and third hubs with the respective first, second and third stator vanes extending radially therefrom; and a bearing assembly within each of said first, second and third stator hubs with said drive shaft passing through each of said bearing assemblies so that said drive shaft is securely maintained in its desired position within said housing by said first, second, and third stators.

14. The turbine hydrojet drive of claim 13 wherein the inwardly disposed edge of said top end of said exhaust nozzle is tapered to direct the water-gas fluid for expansion beyond the exhaust nozzle so that any low pressure vortices created do not produce drag on the housing.

15. The turbine hydrojet drive of claim 14 wherein each of said first, second and third compressor rotors include respective centrally located hubs with the respective first, second and third rotor blades extending radially therefrom and with each of said blades being secured to their respective first, second and third rotor hubs by means of a bulbroot assembly; and wherein each of said first, second and third stators includes respective centrally located first, second and third stator hubs with the respective first, second and third vanes extending radially therefrom and with each of said first, second and third vanes secured to its respective first, second and third stator hubs by means of a bulbroot assembly.

16. The method of operating a hydrojet drive submerged in water, consisting of a recombination of gaseous components predominantly oxygen and hydrogen, comprising the steps of:

drawing the water into an elongated cylindrical housing having a central axis;

rotating the water and forcing the water against the walls of the housing and against stator vanes so as to cause a portion of the water to separate into its gaseous components thus producing a water-gas fluid;

compressing the water-gas fluid;

reorienting the flow of the water-gas fluid into a path generally along the axis of the housing;

reducing the pressure of the water-gas fluid within a buffer zone;

compressing the water-gas fluid discharged from the buffer zone prior to exhaust from the drive;

exhausting the compressed water-gas fluid from the housing thus producing a forward thrust;

rotating the water-gas fluid a second time and forcing it against the walls of the housing and against a plurality of second stator vanes so as to cause an additional amount of the water to separate into its gaseous components;

compressing the water-gas fluid for a second time;

reorienting the flow of the water-gas fluid for a second time into a path generally along the axis of the housing;

reorienting the water-gas fluid for a third time prior to decreasing the pressure of the water-gas fluid within the buffer zone;

forcing the water against the walls of the housing and against the vanes of a third stator so as to cause still and additional amount of water to separate into its gaseous components;

compressing the water-gas fluid for a third time;

compressing the water-gas fluid in an exhaust nozzle after discharge from the buffer zone prior to exhausting the water-gas fluid from the housing so as to increase the thrust generated by said drive; and positioning with respect to the housing the direction of the water-gas fluid exhaust from the drive.

* * * * *